US007561128B2

(12) United States Patent
Ahn et al.

(10) Patent No.: US 7,561,128 B2
(45) Date of Patent: Jul. 14, 2009

(54) ORGANIC ELECTROLUMINESCENCE DISPLAY DEVICE

(75) Inventors: Seong Jun Ahn, Kyoungki-do (KR); Chang Soo Pyon, Seoul (KR)

(73) Assignee: Hydis Technologies Co., Ltd, Gyeonggi-do (KR)

( * ) Notice: Subject to any disclaimer, the term of this patent is extended or adjusted under 35 U.S.C. 154(b) by 640 days.

(21) Appl. No.: 11/266,120

(22) Filed: Nov. 3, 2005

(65) Prior Publication Data

US 2006/0244688 A1 Nov. 2, 2006

(30) Foreign Application Priority Data

Apr. 29, 2005 (KR) ..... 10-2005-0036116

(51) Int. Cl.
*G09G 3/32* (2006.01)

(52) U.S. Cl. ..... 345/82; 345/205; 345/206; 345/83; 345/44; 345/76; 345/46; 345/78; 345/91; 345/92; 345/90; 315/169.1; 315/169.2; 315/169.3; 315/169.4; 257/72; 257/59; 313/463

(58) Field of Classification Search ..... 345/76, 345/30, 45, 82, 90, 60–72; 313/463; 315/169.1, 315/169.3; 257/59, 72
See application file for complete search history.

(56) References Cited

U.S. PATENT DOCUMENTS 7,286,106 B2 * 10/2007 Komiya et al. ..... 345/82

FOREIGN PATENT DOCUMENTS

KR 10-2004-0093785 A 11/2004
KR 10-2005-0005646 A 1/2005

* cited by examiner

*Primary Examiner*—Richard Hjerpe
*Assistant Examiner*—Ishara T Perumpulliarachchige

(57) ABSTRACT

A pixel unit for an organic electroluminescence display device includes four switching transistors, a driving transistor, a capacitor and an organic light emitting diode, configured in a circuit to prevent picture quality deterioration of the display device due to deterioration of the transistors characteristics in a pixel unit.

5 Claims, 3 Drawing Sheets

ORGANIC ELECTROLUMINESCENCE DISPLAY DEVICE

BACKGROUND OF THE INVENTION

1. Field of the Invention

The present invention relates to an organic electroluminescence display device, and more particularly to an organic electroluminescence display device which can prevent picture quality deterioration due to the characteristic deterioration of transistors provided in respective pixels.

2. Description of the Prior Art

Currently, the use of a liquid crystal display (LCD), which is a display device that is in replacement of a CRT, is gradually increasing. Since the LCD is not a self-luminous display, it requires a separate light source, and this causes power consumption to be heightened and thinning of the LCD to be limited. Additionally, since the LCD obtains an image signal by the reaction of the liquid crystal, the display of a high-speed moving image is limited due to response time of the liquid crystal. Also, its viewing angle is limited. As described above, an organic electroluminescence display device has been developed as a display device that is in replacement of the LCD. This organic electroluminescence display device uses the phenomenon of light emission of an organic or polymeric material when an electric field is applied to the organic or polymeric material.

Hereinafter, an organic electroluminescence display device will be explained with reference to FIG. 1.

FIG. 1 is a block diagram illustrating the construction of an organic electroluminescence display device.

The organic electroluminescence display device is provided with a panel 11, a gate driver 12 and a data driver 13 connected to the panel 11, and a timing control unit 14 for controlling the panel 11, the gate driver 12 and the data driver 13. The panel 11 includes a plurality of gate lines G1, G2, . . . , Gm-1 and Gm arranged in parallel and a plurality of data lines D1, D2, Dn-1 and Dn arranged to cross the gate lines G1, G2, . . . , Gm-1 and Gm. In areas surrounded by the gate lines G1, G2, . . . , Gm-1 and Gm and the data lines D1, D2, Dn-1 and Dn, which are in the form of a matrix, respectively, unit pixels are formed.

FIG. 2 is a circuit diagram illustrating each pixel of a conventional organic electroluminescence display device.

Referring to FIG. 2, each pixel of the conventional organic electroluminescence display device is provided with a switching transistor T1, a capacitor C, a driving transistor T2 and an organic LED OLED1.

The drain terminal of the switching transistor T1 is connected to a data line D, and its gate terminal is connected to a gate line G. The switching transistor T1 is turned on/off by the gate signal transferred to the gate line G. If the transistor T1 is turned on, it transfers a data signal from the data line D to the capacitor C and the driving transistor T2. The capacitor C is connected to a power line P for supplying an external voltage, and maintains the data signal for one frame. The gate terminal of the driving transistor T2 is connected to the source terminal of the switching transistor T1 and the capacitor C, and its drain terminal is connected to the power line P. The driving transistor T2 is turned on/off by the data signal applied from the switching transistor T1 and the data signal charged in the capacitor C, i.e., by the data signal on a common connection terminal of the switching transistor T1 and the capacitor C. If the driving transistor T2 is turned on by the data signal, it adjusts the amount of current flowing through the power line P and transfers the adjusted current to the organic LED OLED1. As a result, the organic LED OLED1 irradiates light in proportion to the amount of current i1 transferred to the organic LED. Here, the anode of the organic LED OLED1 is connected to the source terminal of the driving transistor T2 and the cathode terminal of the organic LED OLED1 is connected to the ground terminal GND.

In the conventional organic electroluminescence display device, if the pixel is turned on by the gate signal, the driving transistor T2 provided in the pixel is turned on for a frame by the data signal on the common connection terminal of the switching transistor T1 and the capacitor C, and continuously applies the current i1 to the organic LED OLED1. Accordingly, the characteristic of the driving transistor T2 deteriorates to cause the threshold voltage Vth of the driving transistor T2 to be changed. If the output current of the driving transistor T2 is changed due to the change of the threshold voltage Vth, the uniformity and luminance of light irradiated by the organic LED OLED1 are degraded to cause the picture quality deterioration, and the lifespan of the organic LED OLED1 is shortened to cause the lifespan of the organic electroluminescence display device also to be shortened.

SUMMARY OF THE INVENTION

Accordingly, the present invention has been made to solve the above-mentioned problems occurring in the prior art, and an object of the present invention is to provide an organic electroluminescence display device which can extend the lifespan of the device and improve picture quality by preventing picture quality deterioration due to the characteristic deterioration of transistors provided in respective pixels.

In order to accomplish this object, there is provided an organic electroluminescence display device including a plurality of data lines for transferring a data signal, a plurality of gate lines, arranged to cross the data lines, for transferring a gate signal, and a plurality of pixels formed by the data lines and the gate lines, the respective pixel comprising: a first switching transistor having a drain terminal connected to the data line and a gate terminal connected to the gate line; a second switching transistor having a source terminal connected to the source terminal of the first switching transistor and a gate terminal receiving a gate signal of a previous pixel; a capacitor having one terminal connected to the source terminals of the first and second switching transistors; a third switching transistor having a source terminal connected to the drain terminal of the second switching transistor, a drain terminal receiving an external voltage, and a gate terminal receiving a control signal; a driving transistor having a drain terminal connected to the source terminal of the third switching transistor and a gate terminal connected to a common source terminal of the first and second switching transistors; a fourth switching transistor having a drain terminal connected to the source terminal of the driving transistor and one terminal of the capacitor, a source terminal connected to a ground terminal, and a gate terminal receiving the gate signal of the previous pixel; and an organic light emitting means, connected to the source terminal of the driving transistor, for emitting light according to the amount of current flowing through the source terminal of the driving transistor.

The control signal may be a pulse signal of which the level transition occurs when the gate signal of the previous pixel and a gate signal of a current pixel are applied.

The control signal may be maintained at a constant level before the gate signal of the previous pixel is applied.

The control signal may be maintained at a low level while the gate signal of the previous pixel is applied, and maintained at a high level while the gate signal of the current pixel is applied.

The capacitor is charged with an electric charge as much as the threshold voltage of the driving transistor while the gate signal of the previous pixel is applied, and is charged with an electric charge as much as the data signal while the gate signal of the current pixel is applied.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
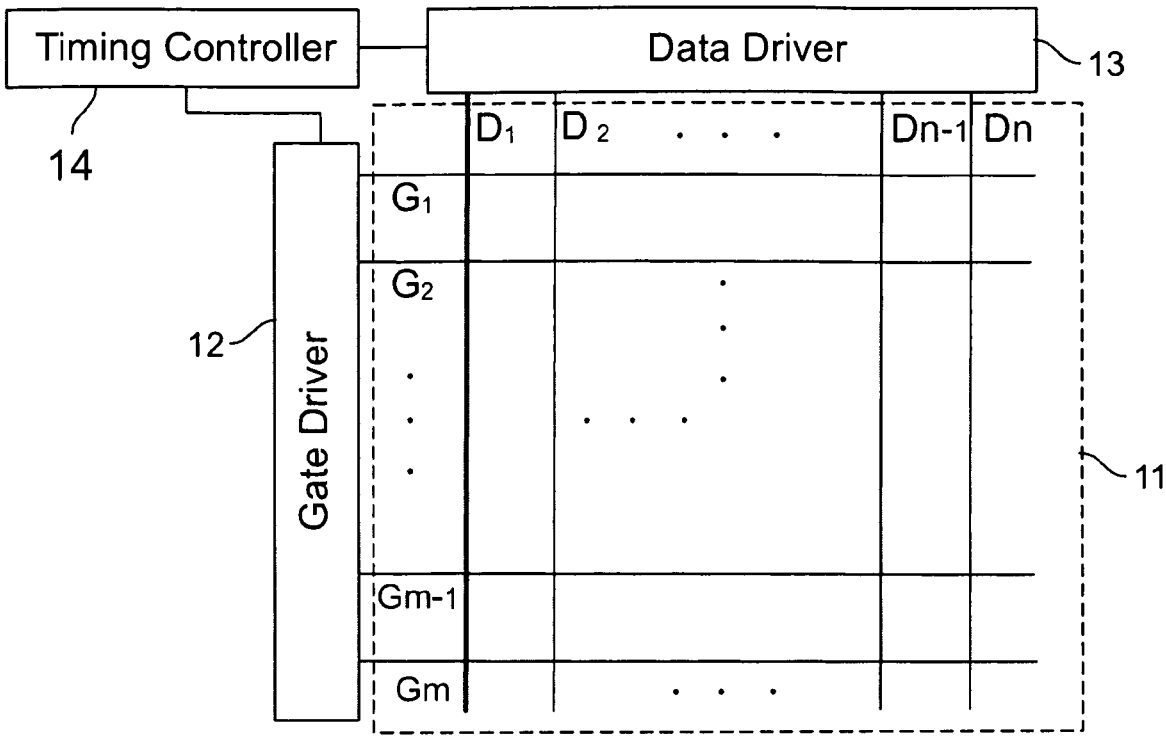
FIG. 1 PRIOR ART
FIG. 1 is a block diagram illustrating the construction of an organic electroluminescence display device.
Figure 2:
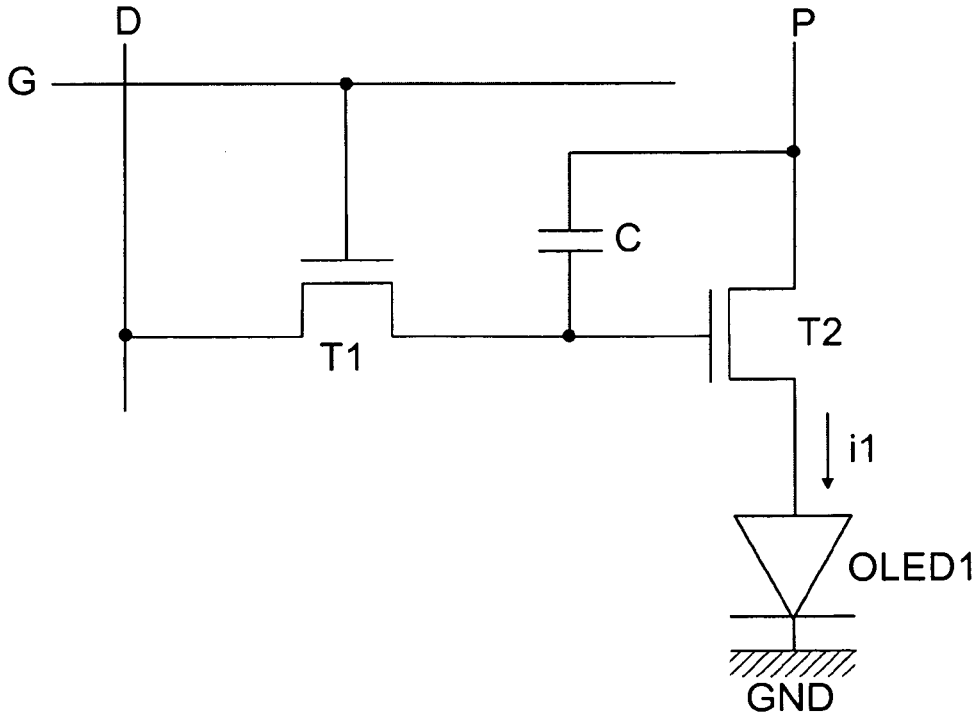
FIG. 2 PRIOR ART
FIG. 2 is a circuit diagram illustrating each pixel of a conventional organic electroluminescence display device.

Hereinafter, a preferred embodiment of the present invention will be described with reference to the accompanying drawings. In the following description and drawings, the same reference numerals are used to designate the same or similar components, and so repetition of the description on the same or similar components will be omitted.

Figure 3:
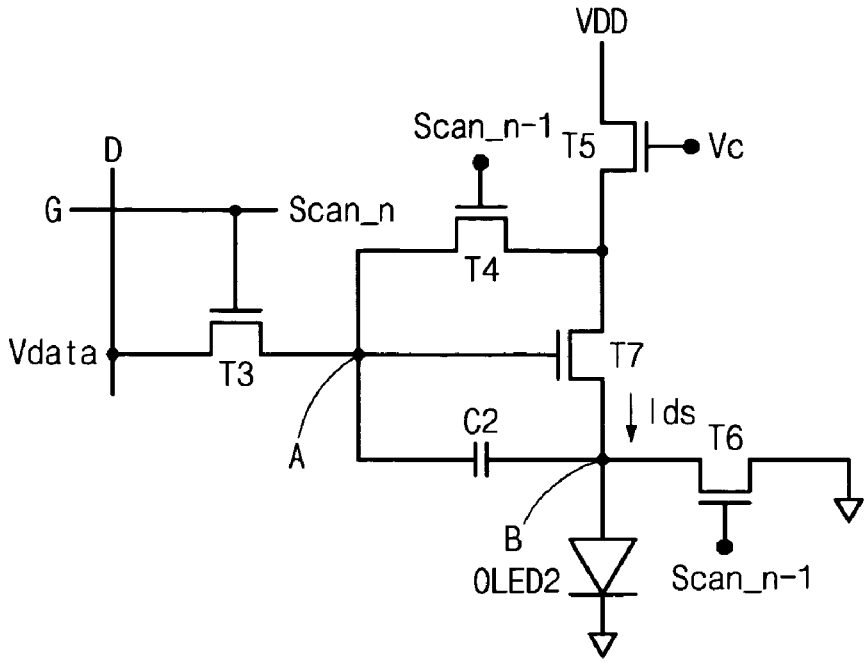
FIG. 3 is a circuit diagram showing each pixel of an organic electroluminescence display device according an embodiment of the present invention.

FIG. 3 is a circuit diagram showing each pixel of an organic electroluminescence display device according an embodiment of the present invention.

Each pixel of the organic electroluminescence display device according the embodiment includes switching transistors T3, T4, T5, and T6, a capacitor C2, a driving transistor T7, and an organic light emitting diode OLED2.

A drain terminal of the first switching transistor T3 is connected to a data line D, and a gate terminal thereof is connected to a gate line G. The first switching transistor T3 is turned off/on by a first gate signal scan_n transferred to the gate line G.

A source terminal of the first switching transistor T3 is connected to a source terminal of the second switching transistor T4, and also is connected to a gate terminal of the driving transistor T7 and one potential of the capacitor C2.

The capacitor C2 is charged with a data signal Vdata transferred from the first switching transistor T3, which maintains the data signal Vdata for one frame period.

A drain terminal of the second transistor T4 is connected to a source terminal of the third switching transistor T5, and also is connected to a drain terminal of the driving transistor T7. In addition, the second transistor T4 is turned off/on by a second gate signal scan_n-1 which is a gate signal of a previous pixel to be transferred to the gate terminal.

A drain terminal of the third switching transistor T5 is connected to an external voltage VDD. The third transistor T5 is turned on/off by a control signal Vc to be transferred to a gate terminal thereof. If the second gate signal scan_n-1 is inputted, the transition of the control signal Vc from a high level state into a low level state occurs. Also, the control signal Vc of the low level state is again returned to the high level state in the case in which the first gate signal scan_n of the interested pixel is input.

A source terminal of the driving transistor T7 is connected to one potential of the capacitor C2, and also is connected to a drain terminal of the fourth switching transistor T6 and an anode of the organic light emitting diode OLED2. Also, a source terminal of the fourth switching transistor T6 is connected a ground terminal GND, and a gate terminal thereof receives the second gate signal scan_n-1 to turn on/off. A cathode of the organic light emitting diode OLED2 is connected to the ground terminal GND.

The organic electroluminescence display device according to the embodiment of the present invention operates differently by periods using threshold voltages Vth of the driving transistor T7, i.e., a period where the second gate signal is applied and a period where the organic light emitting diode OLED2 emits light.

Figure 4:
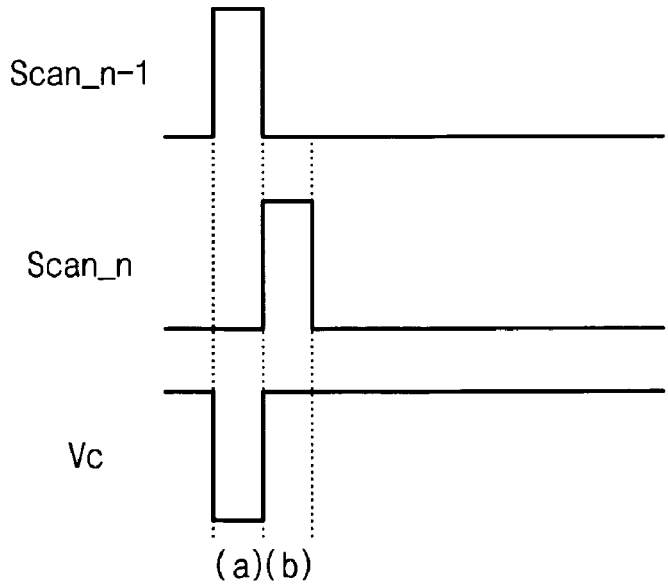
FIG. 4 is a waveform diagram explaining the operation of an organic electroluminescence display device according to an embodiment of the present invention.

The operation of the organic electroluminescence display device having the above operating characteristics according to the embodiment of the present invention will now be described with reference to FIG. 4. FIG. 4 is a waveform diagram explaining the operation of the organic electroluminescence display device according to the embodiment.

First, an operation characteristic in a period (a) where the organic electroluminescence display device according to the embodiment of the present invention uses a threshold voltage Vth of the driving transistor T7 will be explained.

Figure 5A:
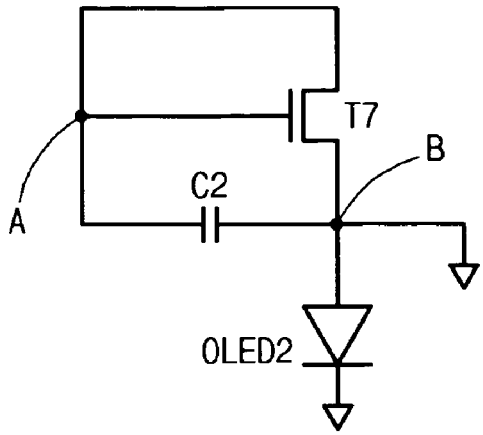
FIGS. 5A and 5B are views illustrating voltage paths for each operating range of an organic electroluminescence display device according to an embodiment of the present invention.

The gate signal scan_n-1 of the previous pixel which is enabled at a high level turns on the second switching transistor T4 and the fourth transistor T6, which forms a voltage pass as shown in FIG. 5A. Hence, the driving transistor T7 becomes a diode connection. At this time, the voltage of the source terminal (node B) of the driving transistor T7 is at a ground (GND) level, and the gate terminal (node A) maintains the level of the threshold voltage Vth of the transistor. Furthermore since the first gate signal scan_n and the control signal Vc are in a disabled state of a low level, the first switching transistor T3 and the third switching transistor T5 which receive the signals are maintained in a turned-off state. Consequently, the external voltage VDD is not applied to the inside of the pixel.

Next, the operation characteristic in a period (b) where the organic light emitting diode OLED2 of the organic electroluminescence display device according to the embodiment of the present invention emits light will be explained.

Figure 5B:
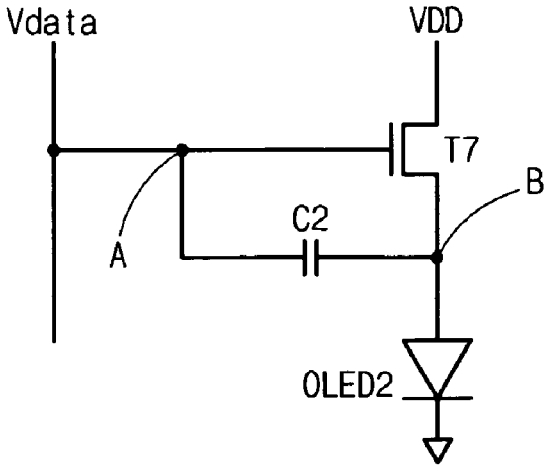

In the period where the organic light emitting diode OLED2 emits the light, the second gate signal scan_n-1 is disabled at a low level, the second and fourth switching transistors T4 and T6 are turned off by the disabled second gate signal scan_n-1. Also, the first gate signal scan_n is inputted at a high level, so that the control signal Vc inputted to the third switching transistor T5 is enabled at a high level, thereby forming a voltage pass as shown in FIG. 5B. Hence, the first switching transistor T3, the third transistor T5, and the driving transistor T7 are turned on, and the organic light emitting diode OLED2 emits light. In other words, if the first gate signal scan_n is inputted, the first switching transistor T3 is turned on, and the data signal Vdata applied through data line D is transferred to the source terminal (node A) of the first switching transistor T3. Consequently, the source terminal (node A) of the first switching transistor T3 is transferred with a voltage value added up to the threshold voltage Vth of the driving transistor T7 and the voltage Vdata according to the data signal, and the voltage value is also transferred to the gate voltage of the driving transistor T7 and the capacitor C2. Accordingly, the external voltage VDD is transferred to the organic light emitting diode OLED2 through the driving transistor T7, so that the organic light emitting diode OLED2 emits light. The capacitor C2 is discharged by stored charge, i.e., charge added up to the data signal Vdata and the threshold voltage Vth, to maintain the data signal Vdata for one frame even if the data signal Vdata is not applied to the pixel.

Furthermore, in the region where the organic light emitting diode OLED2 emits light, current Ids flowing through the driving transistor T7 is determined by the following equation.

$$Ids = k(Vgs - Vth)^2 : k = \frac{1}{2} \times u \times Ci \times \frac{W}{L}$$

In the above equation, u denotes mobility of the driving transistor T7, Ci denotes a gate capacity per unit area, and W/L denotes a size of the transistor.

As will be understood from the above equation, the current Ids flowing through the driving transistor T7 is as follows.

$$Ids=k(Vgs-Vth)^2$$

$$Ids=k\{(Vdata+Vth)-Vel-Vth)\}^2$$

$Ids=k(Vdata-Vel)^2$: $Vel$=drive voltage of organic light emitting diode OLED2

As will be understood from the above equations, the current Ids flowing through the driving transistor T7 is determined irrespective of variation of the threshold voltage Vth. In other words, the charge stored in the capacitor C2, i.e., an amount of charge added up to the data signal Vdata and the threshold voltage Vth of the driving transistor T7, is applied to the gate terminal of the driving transistor T7, thereby supplying stable voltage Ids to the organic light emitting diode OLED2, irrespective of the variation of the threshold voltage Vth produced due to the characteristic deterioration of the driving transistor T7.

As described above, the present invention can prevent an output current from being reduced due to threshold voltage varied by stress applied to a driving transistor over a long time, thereby preventing deterioration of picture brightness and improving the lifespan and reliability of the device.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An organic electroluminescence display device including a plurality of data lines for transferring a data signal, a plurality of gate lines, arranged to cross the data lines, for transferring a gate signal, and a plurality of pixels formed by the data lines and the gate lines, the respective pixel comprising:

a first switching transistor having a drain terminal connected to the data line and a gate terminal connected to the gate line;

a second switching transistor having a source terminal connected directly to the source terminal of the first switching transistor and a gate terminal receiving a gate signal of a previous pixel;

a capacitor having one terminal connected to the source terminals of the first and second switching transistors;

a third switching transistor having a source terminal connected to the drain terminal of the second switching transistor, a drain terminal receiving an external voltage, and a gate terminal receiving a control signal;

a driving transistor having a drain terminal connected to the source terminal of the third switching transistor and a gate terminal connected to a common source terminal of the first and second switching transistors;

a fourth switching transistor having a drain terminal connected to the source terminal of the driving transistor and one terminal of the capacitor, a source terminal connected to a ground terminal, and a gate terminal receiving the gate signal of the previous pixel; and an organic light emitting means, connected to the source terminal of the driving transistor, for emitting light according to an amount of current flowing through the source terminal of the driving transistor.

2. The device as claimed in claim 1, wherein the control signal is a pulse signal of which the level transition occurs when the gate signal of the previous pixel and a gate signal of a current pixel are applied.

3. The device as claimed in claim 2, wherein the control signal is maintained at a constant level before the gate signal of the previous pixel is applied.

4. The device as claimed in claim 2, wherein the control signal is maintained at a low level while the gate signal of the previous pixel is applied, and maintained at a high level while the gate signal of the current pixel is applied.

5. The device as claimed in claim 1, wherein the capacitor is charged with an electric charge as much as the threshold voltage of the driving transistor while the gate signal of the previous pixel is applied, and is charged with an electric charge as much as the data signal while the gate signal of the current pixel is applied.

* * * * *